US008245529B2

(12) United States Patent
Kurihara et al.

(10) Patent No.: US 8,245,529 B2
(45) Date of Patent: Aug. 21, 2012

(54) TURBO COMPRESSOR AND REFRIGERATOR

(75) Inventors: Kazuaki Kurihara, Yokohama (JP); Minoru Tsukamoto, Yokohama (JP)

(73) Assignee: IHI Corporation (JP)

( * ) Notice: Subject to any disclaimer, the term of this patent is extended or adjusted under 35 U.S.C. 154(b) by 776 days.

(21) Appl. No.: 12/366,923

(22) Filed: Feb. 6, 2009

(65) Prior Publication Data

US 2009/0193840 A1 Aug. 6, 2009

(30) Foreign Application Priority Data

Feb. 6, 2008 (JP) ..... P2008-027074

(51) Int. Cl.
*F25B 43/02* (2006.01)

(52) U.S. Cl. ..... 62/468

(58) Field of Classification Search ..... 62/468, 62/498

See application file for complete search history.

(56) References Cited

U.S. PATENT DOCUMENTS

| | | | | |
|---|---|---|---|---|
| 3,728,857 | A * | 4/1973 | Nichols | 62/469 |
| 4,237,689 | A * | 12/1980 | Sampietro | 60/599 |
| 2007/0147984 | A1 | 6/2007 | Takahashi et al. | 415/100 |
| 2008/0019629 | A1 | 1/2008 | McKeirnan | |

FOREIGN PATENT DOCUMENTS

| | | |
|---|---|---|
| CN | 1991182 | 7/2007 |
| JP | 2002-303298 | 10/2002 |
| JP | 2004-092414 | 3/2004 |
| JP | 2006-336767 | 12/2006 |
| JP | 2007-177695 | 7/2007 |

OTHER PUBLICATIONS

Chinese Office Action issued Jul. 9, 2010 in connection with corresponding Chinese Patent Application No. 200910003834.7 with English Language Translation.

Japanese Office Action, dated Jun. 12, 2012, issued in corresponding Japanese Application No. 2008-027074, with English translation. Total 6 pages.

* cited by examiner

*Primary Examiner* — Melvin Jones
(74) *Attorney, Agent, or Firm* — Ostrolenk Faber LLP

(57) ABSTRACT

A turbo compressor includes a first impeller and a second impeller, which are spaced apart at a predetermined distance from each other in a direction of an axis and are fixed such that their backs face each other, in a rotation shaft which is rotatably supported around the axis. Two angular contact ball bearings are provided between the first impeller and the second impeller to rotatably support the rotation shaft around the axis. The two angular contact ball bearings are combined such that their fronts face each other. According to this turbo compressor, robustness can be improved against the inclination of the rotation shaft, any damage of the bearings can be prevented, and the lifespan thereof can be extended.

4 Claims, 5 Drawing Sheets

TURBO COMPRESSOR AND REFRIGERATOR

BACKGROUND OF THE INVENTION

1. Field of the Invention

The present invention relates to a turbo compressor capable of compressing a fluid by a plurality of impellers, and a refrigerator including the turbo compressor.

Priority is claimed on Japanese Patent Application No. 2008-27074, filed Feb. 6, 2008, the content of which is incorporated herein by reference.

2. Description of the Related Art

As refrigerators which cool or freeze objects to be cooled, such as water, a turbo refrigerator or the like including a turbo compressor which compresses and discharges a refrigerant is known.

A turbo compressor included in the turbo refrigerator or the like generally includes a compression mechanism which rotates an impeller attached to a rotation shaft around an axis, and compresses a refrigerant. Conventionally, bearings which rotatably support the rotation shaft of such a compression mechanism around the axis are described in, for example, Japanese Patent Unexamined Publication No. 2002-303298, and Japanese Patent Unexamined Publication No. 2007-177695.

A configuration in which a compressor shaft (rotation shaft) is supported by angular contact ball bearings in a back-to-back state is disclosed in Japanese Patent Unexamined Publication No. 2002-303298. By supporting the rotation shaft by the angular contact ball bearings, the ball bearings can withstand a force applied to the rotation shaft in a thrust direction, and power can be transmitted efficiently with little power loss.

Additionally, a turbo compressor which includes two compression stages (compression mechanism) and which compresses a refrigerant sequentially in these compression mechanisms is disclosed in Japanese Patent Unexamined Publication No. 2007-177695. In this turbo compressor, two same impellers are fixed to the same rotation shaft such that their backs face each other. By supporting the rotation shaft by the journal bearings between the two impellers, an overhang load applied to the rotation shaft is reduced.

Meanwhile, in the turbo compressor, when a compression ratio may increase, the discharge temperature may become high and the volumetric efficiency may degrade. Therefore, the compression mechanism may perform compression of a refrigerant in a plurality of stages as described in Japanese Patent Unexamined Publication No. 2007-177695. In such a turbo compressor, the compressor is manufactured by combining a number of casings, and the rotation shaft is attached such that it is inserted through the casings.

However, the center of the rotation shaft may deviate due to eccentricity resulting from an accumulated error by an inevitable gap between the spigot portions of the casings for combining these casings together, or an allowance for the inclination of the rotation shaft may be exceeded in the bearings which support the rotation shaft. Particularly, the angular contact ball bearings in a back-to-back state disclosed in Japanese Patent Unexamined Publication No. 2002-303298 have high support rigidity but a small allowance for inclination. This becomes problematic. Additionally, when the distance between the bearings has become long by a combination of a number of casings, deflection by a gear reaction force or the like is apt to occur and the rotation shaft inclines. This becomes problematic.

Accordingly, the load by the inclination will act on the bearings in a normal state, and consequently there is a concern that the bearings receive fatigue and damage by the action, and their lifespan is shortened.

SUMMARY OF THE INVENTION

The invention was made in view of the above problems, and aims at providing a turbo compressor capable of preventing any damage of bearings and extending the lifespan thereof, and a refrigerator including the turbo compressor.

The following means is adopted in order to solve the above problems. That is, the turbo compressor of the invention includes a rotation shaft which is rotatably supported around an axis, and a first impeller and a second impeller which are spaced apart at a predetermined distance from each other in a direction of the axis, and which are fixed to the rotation shaft such that their backs face each other. Two angular contact ball bearings are provided between the first impeller and the second impeller to rotatably support the rotation shaft around the axis. The two angular contact ball bearings are combined such that their fronts face each other.

According to the turbo compressor of the invention, as the two angular contact ball bearings support the rotation shaft between the first impeller and the second impeller, an overhang load can be reduced, and any load in the thrust direction as well as the radial direction can also be received by the angular contact ball bearings. Moreover, an allowance for the inclination of the rotation shaft can be increased by adopting the angular contact ball bearings which are combined such that their fronts face each other.

In the turbo compressor of the invention, one end of the rotation shaft may be supported by a first structure via the two angular contact ball bearings, and the other end of the rotation shaft may be supported by a second structure different from the first structure.

According to the turbo compressor of the invention, when the rotation shaft is supported by different structures by a combination of a number of structures, it is possible to cope with any inclination by the eccentricity which is apt to occur in the rotation shaft.

The turbo compressor of the invention may further include a lubricant-supplying device which supplies lubricant to both the angular contact bearings through a gap between the two bearings from above.

According to the turbo compressor of the invention, in a case where the two angular contact ball bearings are combined such that their fronts face each other, when lubricant is supplied from above through the gap between both the angular contact ball bearings, the flow path for the lubricant is formed so as to incline downward toward the outside from the inside in the direction of the axis by a combination structure of counter-bored outer and inner rings of the angular contact ball bearings. Hence, supply of lubricant to the angular contact ball bearings which are combined such that their fronts face each other can be smoothly performed from one spot.

A refrigerator of the invention includes a condenser which cools and liquefies a compressed refrigerant, an evaporator which evaporates the liquefied refrigerant and deprives vaporization heat from an object to be cooled, thereby cooling the object to be cooled, and the above turbo compressor. The turbo compressor compresses the refrigerant evaporated in the evaporator and supplies the refrigerant to the condenser.

According to the refrigerator of the invention, the refrigerator including a turbo compressor capable of preventing any damage of the bearings and extending the lifespan thereof can be obtained.

According to the invention, as the angular contact ball bearings support the rotation shaft between the first impeller and the second impeller, an overhang load can be reduced, and any load in the thrust direction as well as the radial direction can also be received by the angular contact ball bearings. Moreover, an allowance for the inclination of the rotation shaft can be increased by adopting the angular contact ball bearings which are combined such that their fronts face each other.

Accordingly, in the invention, the turbo compressor capable of improving robustness against the inclination of the rotation shaft, damage of the bearings can be prevented and the lifespan thereof can be extended.

DETAILED DESCRIPTION OF THE INVENTION

Hereinafter, an embodiment of the invention will be described with reference to the drawings.

Figure 1:
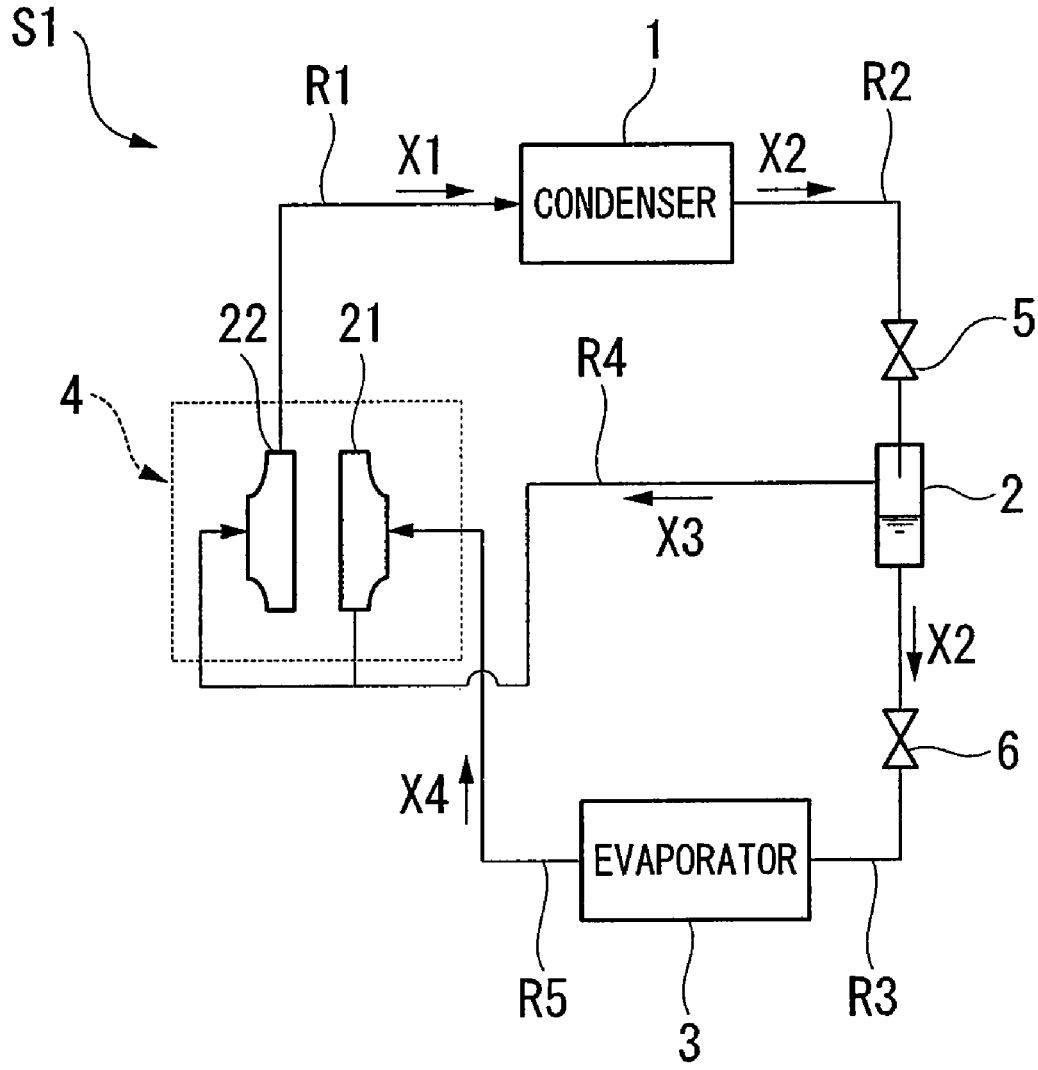
FIG. 1 is a block diagram showing a schematic configuration of a turbo refrigerator in an embodiment of the invention.

The turbo refrigerator S1 in this embodiment is installed in buildings or factories in order to generate, for example, cooling water for air conditioning. As shown in FIG. 1, the turbo refrigerator S1 includes a condenser 1, an economizer 2, an evaporator 3, and a turbo compressor 4.

The condenser 1 is supplied with a compressed refrigerant gas X1 in a gaseous state, and cools and liquefies the compressed refrigerant gas X1 to generate a refrigerant fluid X2. The condenser 1, as shown in FIG. 1, is connected to the turbo compressor 4 via a pipe R1 through which the compressed refrigerant gas X1 flows, and is connected to the economizer 2 via a pipe R2 through which the refrigerant fluid X2 flows. In addition, an expansion valve 5 for decompressing the refrigerant fluid X2 is installed in the pipe R2.

The economizer 2 temporarily stores the refrigerant fluid X2 decompressed in the expansion valve 5. The economizer 2 is connected to the evaporator 3 via a pipe R3 through which the refrigerant fluid X2 flows, and is connected to the turbo compressor 4 via a pipe R4 through which a gaseous refrigerant X3 generated in the economizer 2 flows. In addition, an expansion valve 6 for further decompressing the refrigerant fluid X2 is installed in the pipe R3. Additionally, the pipe R4 is connected to the turbo compressor 4 so as to supply the gaseous refrigerant X3 to a second compression stage 22 included in the turbo compressor 4.

The evaporator 3 evaporates the refrigerant fluid X2 to remove vaporization heat from an object to be cooled, such as water, thereby cooling an object to be cooled. The evaporator 3 is connected to the turbo compressor 4 via a pipe R5 through which a refrigerant gas X4 generated as the refrigerant fluid X2 flows and is evaporated flows. In addition, the pipe R5 is connected to a first compression stage 21 included in the turbo compressor 4.

The turbo compressor 4 compresses the refrigerant gas X4 to generate the compressed refrigerant gas X1. The turbo compressor 4 is connected to the condenser 1 via the pipe R1 through which the compressed refrigerant gas X1 flows as described above, and is connected to the evaporator 3 via the pipe R5 through which the refrigerant gas X4 flows.

In the turbo refrigerator S1, the compressed refrigerant gas X1 supplied to the condenser 1 via the pipe R1 is cooled and liquefied into the refrigerant fluid X2 by the condenser 1.

When the refrigerant fluid X2 is supplied to the economizer 2 via the pipe R2, the refrigerant fluid is decompressed by the expansion valve 5, and is temporarily stored in the economizer 2 in the decompressed state. Thereafter, when the refrigerant fluid is supplied to the evaporator 3 via the pipe R3, the refrigerant gas is further decompressed by the expansion valve 6, and then supplied to the evaporator 3.

The refrigerant fluid X2 supplied to the evaporator 3 is evaporated into the refrigerant gas X4 by the evaporator 3, and is supplied to the turbo compressor 4 via the pipe R5.

The refrigerant gas X4 supplied to the turbo compressor 4 is compressed into the compressed refrigerant gas X1 by the turbo compressor 4, and is supplied again to the condenser 1 via the pipe R1.

In addition, the gaseous refrigerant X3 generated when the refrigerant fluid X2 is stored in the economizer 2 is supplied to the turbo compressor 4 via the pipe R4, compressed along with the refrigerant gas X4, and supplied to the condenser 1 via the pipe R1 as the compressed refrigerant gas X1.

In the turbo refrigerator S1, when the refrigerant fluid X2 is evaporated in the evaporator 3, vaporization heat is removed from an object to be cooled, thereby cooling or refrigerating the object to be cooled.

Subsequently, the turbo compressor 4 will be described in more detail.

Figure 2:
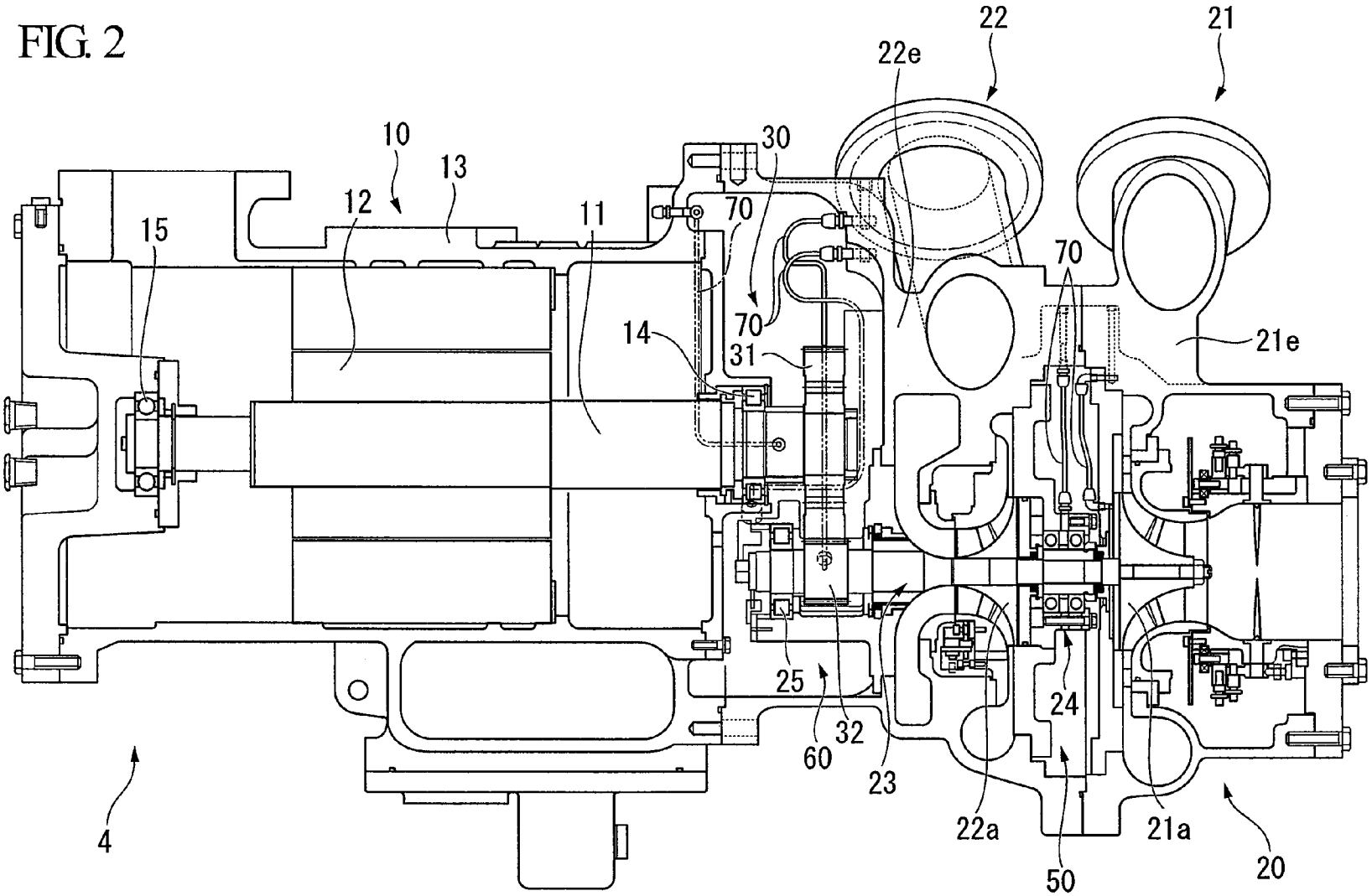
FIG. 2 is a horizontal sectional view of a turbo compressor included in the turbo refrigerator in the embodiment of the invention.
Figure 3:
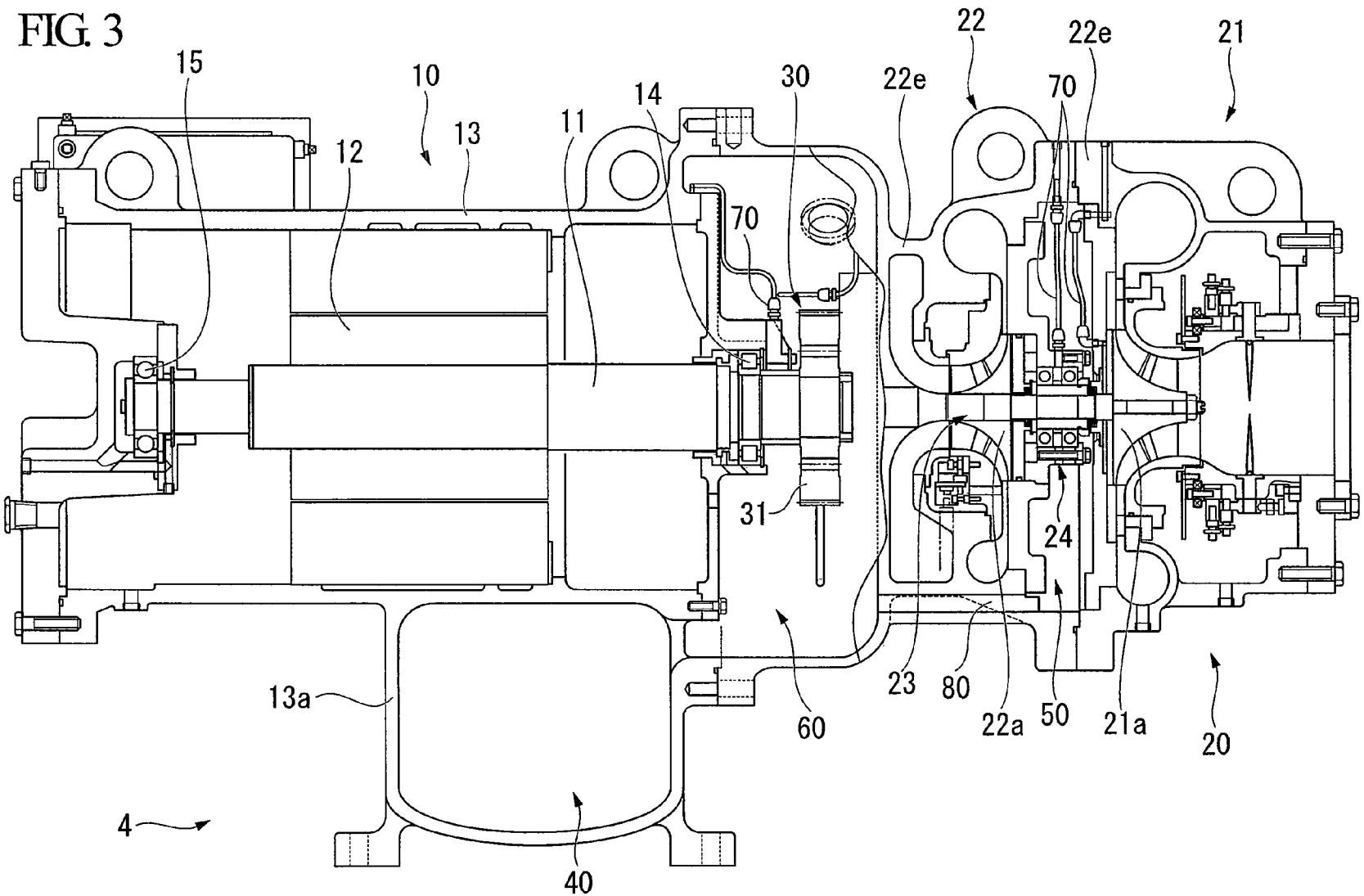
FIG. 3 is a vertical sectional view of a turbo compressor included in the turbo refrigerator in the embodiment of the invention.
Figure 4:
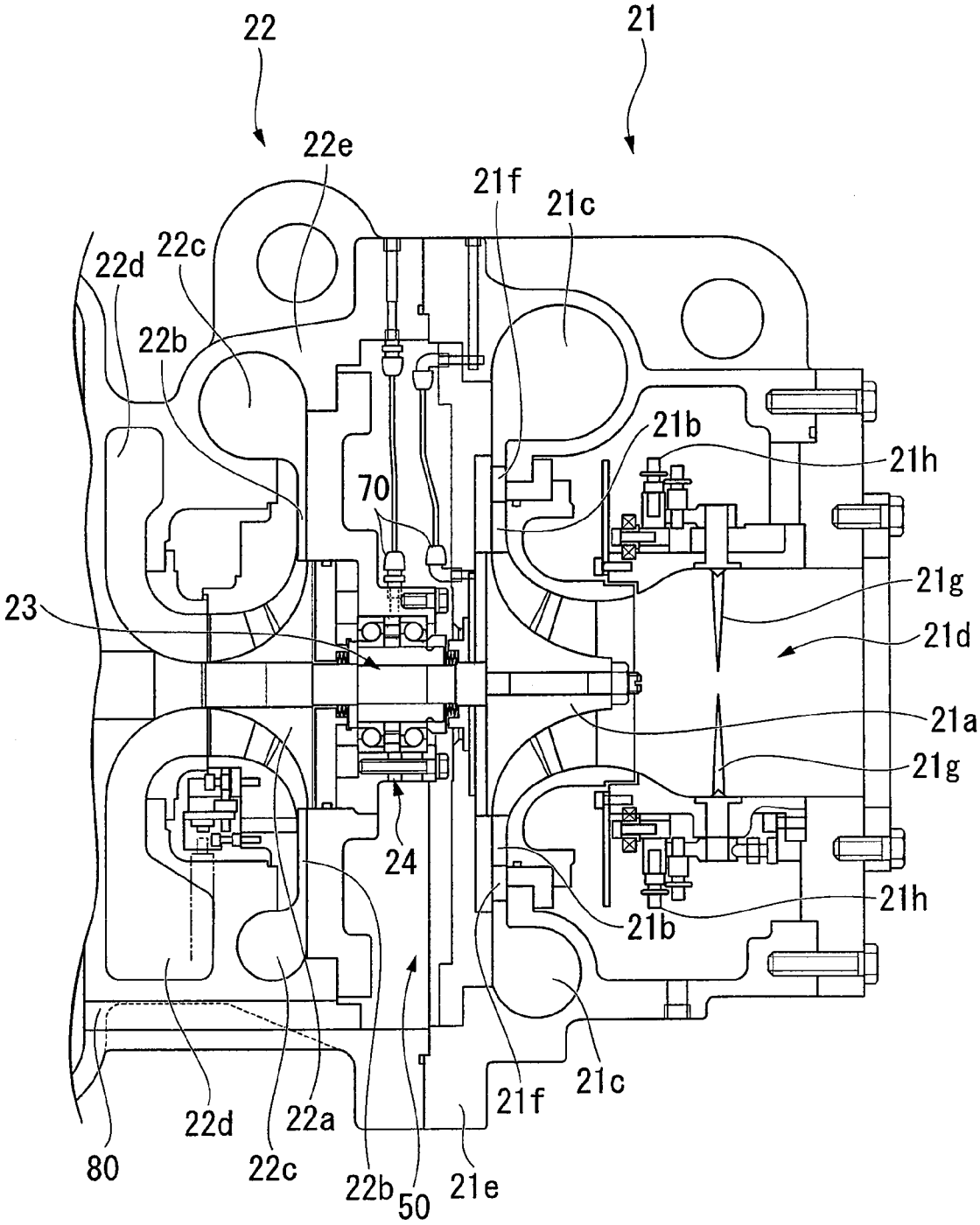
FIG. 4 is an enlarged vertical sectional view of a compressor unit included in the turbo compressor in the embodiment of the invention.

As shown in FIGS. 2 to 4, the turbo compressor 4 in this embodiment includes a motor unit 10, a compressor unit 20, and a gear unit 30.

As shown in FIGS. 2 and 3, the motor unit 10 includes a motor 12 which has an output shaft 11, and a motor housing 13. The motor 12 is a driving source for driving the compressor unit 20. The motor housing 13 surrounds the motor 12 and supports the motor 12.

In addition, the output shaft 11 of the motor 12 is rotatably supported by a first bearing 14 and a second bearing 15 which are fixed to the motor housing 13.

Additionally, the motor housing 13 includes a leg portion 13*a* which supports the turbo compressor 4.

The inside of the leg portion 13*a* is hollow, and functions as the oil tank 40. The lubricant supplied to sliding parts of the turbo compressor 4 is recovered and stored in the oil tank 40.

The compression unit 20 is formed with a flow path through which the refrigerant gas X4 (refer to FIG. 1) circulates. The compression unit 20 compresses the refrigerant gas X4 in multi-stages while the refrigerant gas X4 flows through the flow path. The compression unit 20 includes a first compression stage 21 and a second compression stage 22. In the first compression stage 21, the refrigerant gas X4 is sucked and compressed. In the second compression stage 22, the refrigerant gas X4 compressed in the first compression stage 21 is further compressed, and is discharged as the compressed refrigerant gas X1 (refer to FIG. 1).

The first compression stage 21, as shown in FIG. 4, includes a first impeller 21*a*, a first diffuser 21*b*, a first scroll chamber 21*c*, and a suction port 21*d*.

The first impeller 21*a* gives velocity energy to the refrigerant gas X4 to be supplied from a thrust direction, and discharges the refrigerant gas in a radial direction. The first diffuser 21*b* converts the velocity energy, which is given to the refrigerant gas X4 by the first impeller 21*a*, into pressure energy, thereby compressing the refrigerant gas. The first scroll chamber 21*c* guides the refrigerant gas X4 compressed by the first diffuser 21*b* to the outside of the first compression stage 21. The suction port 21*d* allows the refrigerant gas X4 to be sucked therethrough and be supplied to the first impeller 21*a*.

In addition, the first diffuser 21*b*, the first scroll chamber 21*c*, and a portion of the suction port 21*d* are formed by a first housing 21*e* surrounding the first impeller 21*a*.

The first impeller 21*a* is fixed to a rotation shaft 23, and is rotationally driven as the rotation shaft 23 has rotative power transmitted thereto from the output shaft 11 of the motor 12 and is rotated.

The first diffuser 21*b* is annularly arranged around the first impeller 21*a*. In the turbo compressor 4 of this embodiment, the first diffuser 21*b* is a diffuser with vanes including a plurality of diffuser vanes 21*f* which reduces the turning speed of the refrigerant gas X4 in the first diffuser 21*b*, and efficiently converts velocity energy into pressure energy.

Additionally, a plurality of inlet guide vanes 21*g* for adjusting the suction capacity of the first compression stage 21 is installed in the suction port 21*d* of the first compression stage 21.

Each inlet guide vane 21*g* is rotatable by a driving mechanism 21*h* fixed to the first housing 21*e* so that its apparent area from a flow direction of the refrigerant gas X4 can be changed.

The second compression stage 22 includes a second impeller 22*a*, a second diffuser 22*b*, a second scroll chamber 22*c*, and an introducing scroll chamber 22*d*.

The second impeller 22*a* gives velocity energy to the refrigerant gas X4 which is compressed in the first compression stage 21 and is supplied from the thrust direction, and discharges the refrigerant gas in the radial direction. The second diffuser 22*b* converts the velocity energy, which is given to the refrigerant gas X4 by the second impeller 22*a*, into pressure energy, thereby compressing the refrigerant gas and discharging it as the compressed refrigerant gas X1. The second scroll chamber 22*c* guides the compressed refrigerant gas X1 discharged from the second diffuser 22*b* to the outside of the second compression stage 22. The introducing scroll chamber 22*d* guides the refrigerant gas X4 compressed in the first compression stage 21 to the second impeller 22*a*.

In addition, the second diffuser 22*b*, the second scroll chamber 22*c*, and a portion of the introducing scroll chamber 22*d* are formed by a second housing 22*e* surrounding the second impeller 22*a*.

The second impeller 22*a* is fixed to the rotation shaft 23 so as to face the first impeller 21*a* back to back and is rotationally driven as the rotation shaft 23 has rotative power transmitted thereto from the output shaft 11 of the motor 12 and is rotated.

The second diffuser 22*b* is annularly arranged around the second impeller 22*a*. In the turbo compressor 4 of this embodiment, the second diffuser 22*b* is a vaneless diffuser which does not include a diffuser vane which reduces the turning speed of the refrigerant gas X4 in the second diffuser 22*b*, and efficiently converts velocity energy into pressure energy.

The second scroll chamber 22*c* is connected to the pipe R1 for supplying the compressed refrigerant gas X1 to the condenser 1, and supplies the compressed refrigerant gas X1 drawn from the second compression stage 22 to the pipe R1.

In addition, the first scroll chamber 21*c* of the first compression stage 21 and the introducing scroll chamber 22*d* of the second compression stage 22 are connected together via an external pipe (not shown) which is provided separately from the first compression stage 21 and the second compression stage 22, and the refrigerant gas X4 compressed in the first compression stage 21 is supplied to the second compression stage 22 via the external pipe. The aforementioned pipe R4 (refer to FIG. 1) is connected to this external pipe, and the gaseous refrigerant X3 generated in the economizer 2 is supplied to the second compression stage 22 via the external pipe.

Additionally, the rotation shaft 23 is rotatably supported by a third bearing 24 and a fourth bearing 25 (refer to FIG. 2). Additionally, the third bearing 24 is fixed to the second housing 22*e* of the second compression stage 22 in a space 50 between the first compression stage 21 and the second compression stage 22 (which will be described later in detail). The fourth bearing 25 is fixed to the second housing 22*e* in the motor unit 10. In addition, since the rotation shaft 23 is fixed such that the first impeller 21*a* and the second impeller 22*a* face each other back to back, the rotation shaft is formed such that its diameter becomes small gradually toward the third bearing 24 from the fourth bearing 25.

In addition, the second housing 22*e* is a generic term of a combination of a number of casings (structures). Accordingly, more exactly, a spot to which the third bearing 24 is fixed, and a spot to which the fourth bearing 25 is fixed are fixed to respective different casings.

The gear unit 30, as shown in FIG. 2, is provided so as to transmit the rotative power of the output shaft 11 of the motor 12 to the rotation shaft 23. The gear unit 30 is housed in a space 60 formed by the motor housing 13 of the motor unit 10, and the second housing 22*e* of the compressor unit 20.

The gear unit 30 includes a large-diameter gear 31 fixed to the output shaft 11 of the motor 12, and a small-diameter gear 32 which is fixed to the rotation shaft 23, and meshes with the large-diameter gear 31, and the rotative power of the output shaft 11 of the motor 12 is transmitted to the rotation shaft 23 so that the rotation number of the rotation shaft 23 may increase with an increase in the rotation number of the output shaft 11.

Additionally, the turbo compressor 4 includes a lubricant-supplying device (lubricating oil supplying device) 70. The lubricant-supplying device 70 supplies lubricant (lubricating oil) stored in the oil tank 40 to bearings (the first bearing 14, the second bearing 15, the third bearing 24, and the fourth bearing 25), to between an impeller (the first impeller 21*a* or the second impeller 22*a*) and a housing (the first housing 21*e* or the second housing 22*e*), and to sliding parts, such as the gear unit 30. In addition, only a portion of the lubricant-supplying device 70 is shown in the drawing.

In addition, the space 50 where the third bearing 24 is arranged and the space 60 where the gear unit 30 is housed are connected together by a through-hole 80 formed in the second housing 22*e*, and the space 60 and the oil tank 40 are connected together. For this reason, the lubricant which is supplied to spaces 50 and 60, and flows down from the sliding parts is recovered to the oil tank 40.

Subsequently, the third bearing 24 which rotatably supports the rotation shaft 23 around an axis will be described with reference to FIG. 5.

The third bearing 24 has mounting angular contact ball bearings 100A and 100B combined such that their fronts face each other, and which rotatably support the rotation shaft 23 around the axis, between the first impeller 21*a* and the second impeller 22*a*. Additionally, the third bearing 24 has a filler piece 101 which forms a flow path through which lubricant is supplied from a gap between the mounting angular contact ball bearings 100A and 100B to both of them. The filler piece 101 is attached between the angular contact ball bearings 100A and 100B.

The third bearing 24 supports the rotation shaft 23 via a rotation shaft sleeve 23A provided integrally with the rotation shaft 23. The rotation shaft sleeve 23A is disposed between a first labyrinth seal 21*e*1 provided on the rear side of the first impeller 21*a*, and a second labyrinth seal 22*e*1 provided on the rear side of the second impeller 22*a*.

An inner ring of the third bearing 24 is fixed in its thickness direction (thrust direction) by the rotation shaft sleeve 23A and a lock nut 23B attached to the rotation shaft sleeve 23A.

Meanwhile, an outer ring of the third bearing 24 is fixed in its thickness direction (thrust direction) by a partition wall 22*e*2 of the second compression stage 22, and a shaft presser member 22*e*3 fixed between the partition wall 22*e*2 and the second labyrinth seal 22*e*1.

Additionally, the lubricant-supplying device 70 is provided above the third bearing 24. In this embodiment, a supply pipe 70*a* of the lubricant-supplying device 70 passes through an upper partition wall 22*e*2 vertically downward, and is connected to the filler piece 101. Moreover, a lower partition wall 22*e*2 is provided with a discharge hole 70*b* through which lubricant is discharged in communication with the lower filler piece 101.

Next, the operation of the turbo compressor 4 and the operation of the third bearing 24 which are configured in this way will be described.

First, as shown in FIGS. 2 and 3, lubricant is supplied to respective sliding parts of the turbo compressor 4 from the oil tank 40 by the lubricant-supplying device 70, and then, the motor 12 is driven. Then, the rotative power of the output shaft 11 of the motor 12 is transmitted to the rotation shaft 23 via the gear unit 30, and thereby, the first impeller 21*a* and the second impeller 22*a* of the compressor unit 20 are rotationally driven.

When the first impeller 21*a* is rotationally driven, as shown in FIG. 4, the suction port 21*d* of the first compression stage 21 is in a negative pressure state, and the refrigerant gas X4 from the flow path R5 flows into the first compression stage 21 via the suction port 21*d*.

The refrigerant gas X4 which has flowed into the inside of the first compression stage 21 flows into the first impeller 21*a* from the thrust direction, and the refrigerant gas has velocity energy given thereto by the first impeller 21*a*, and is discharged in the radial direction.

The refrigerant gas X4 discharged from the first impeller 21*a* is compressed as velocity energy and is converted into pressure energy by the first diffuser 21*b*. The refrigerant gas X4 discharged from the first diffuser 21*b* is guided to the outside of the first compression stage 21 via the first scroll chamber 21*c*.

Then, the refrigerant gas X4 guided to the outside of the first compression stage 21 is supplied to the second compression stage 22 via the external pipe.

The refrigerant gas X4 supplied to the second compression stage 22 flows into the second impeller 22*a* from the thrust direction via the introducing scroll chamber 22*d*, and the refrigerant gas has velocity energy given thereto by the second impeller 22*a*, and is discharged in the radial direction.

The refrigerant gas X4 discharged from the second impeller 22*a* is further compressed into the compressed refrigerant gas X1 as velocity energy and is converted into pressure energy by the second diffuser 22*b*.

The compressed refrigerant gas X1 discharged from the second diffuser 22*b* is guided to the outside of the second compression stage 22 via the second scroll chamber 22*c*.

Then, the compressed refrigerant gas X1 guided to the outside of the second compression stage 22 is supplied to the condenser 1 via the flow path R1.

At this time, a radial load and a thrust load act on the rotation shaft 23 by the driving of the first impeller 21*a* and the second impeller 22*a*.

Figure 5:
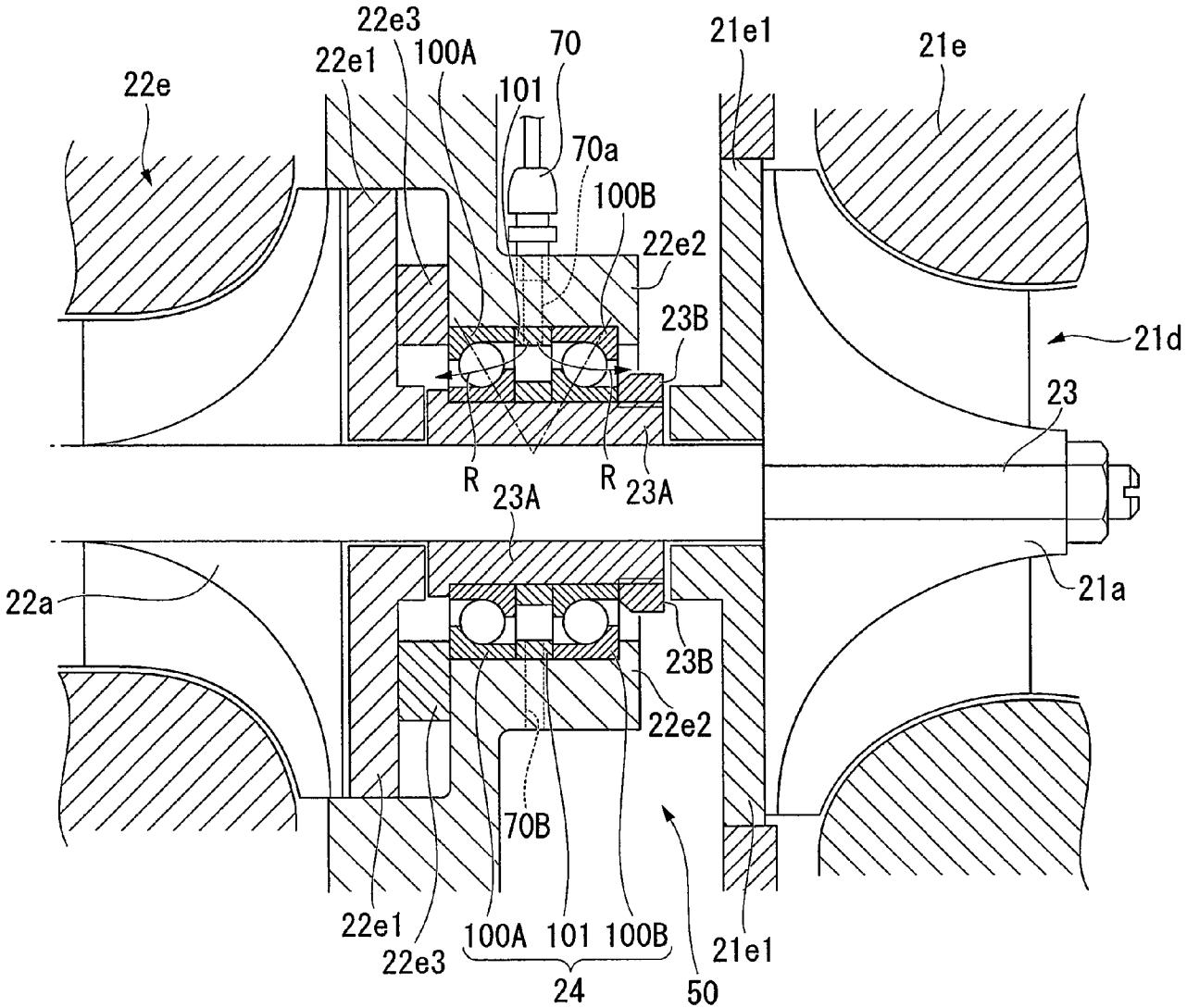
FIG. 5 is an enlarged schematic view of essential parts in FIG. 4, showing a third bearing in the embodiment of the invention.

Since the third bearing 24, as shown in FIG. 5, includes the angular contact ball bearings 100A and 100B, the third bearing can receive not only a radial load but a thrust load. Additionally, since the third bearing 24 supports the rotation shaft 23 between the first impeller 21*a* and the second impeller 22*a*, an overhang amount is reduced compared with the case where the rotation shaft 23 is supported on the near side of the second impeller 22*a* (the left of the second impeller 22*a* in FIG. 2). As a result, the overhang load applied to the rotation shaft 23 can be reduced.

Additionally, since the angular contact ball bearings 100A and 100B are combined such that their fronts face each other, they are formed such that the lines of action of rolling elements of the angular contact ball bearings 100A and 100B approach each other gradually inward at predetermined contact angles, respectively. Since the working point distance when the angular contact ball bearings 100A and 100B are combined such that their fronts face each other becomes smaller compared with the case where the angular contact ball bearings are combined such that their backs face each other, the load capability of the bearings by moment load is inferior. However, in this embodiment, by selecting this configuration intentionally, an allowance which can be enough to lower radial rigidity of bending and absorb the deviation of the center of the rotation shaft 23 can be increased and the rotation of the rotation shaft can be made smooth. This operation is particularly effective in a case where a compressor is comprised of a plurality of casings, and inclination and deflection of the rotation shaft 23 resulting from the dimensional accuracy of the casings, the combinational accuracy of these casings, the small diameter of the rotation shaft 23, and the like become large, as in the turbo compressor 4 of this embodiment.

Moreover, when lubricant is supplied to the angular contact ball bearings 100A and 100B which are combined such that their fronts face each other through the gap between both the bearings 100A and 100B from above, the lubricant is supplied to the filler piece 101 via the supply pipe 70*a*, and then supplied to the angular contact ball bearings 100A and 100B, respectively, via the flow path provided in the filler piece 101.

When lubricant is supplied to the angular contact ball bearings 100A and 100B from above through both the bearings 100A and 100B, a flow path R for the lubricant (refer to FIG. 5) is formed so as to incline downward toward the outside from the inside in the direction of the axis by a combination structure of counter-bored outer and inner rings of the angular contact ball bearings 100A and 100B. Therefore, supply of lubricant to the angular contact ball bearings 100A and 100B can be performed smoothly and easily from one spot by using a difference in height by the above structure. Additionally, in a state where supply of lubricant is received from above, and the lubricant has been smoothly supplied to between rolling elements, between the rolling elements and an outer ring, and between the rolling elements and an inner ring by the above operation, the lubricant can be easily supplied to whole peripheries of the angular contact ball bearings 100A and 100B as the rolling elements are rotationally driven.

In addition, the supplied lubricant is discharged to the space 50 via the axial outside of the angular contact ball bearings 100A and 100B, or the discharge hole 70*b*, and is recovered again to the oil tank 40 (refer to FIG. 3) through the through-hole 80 and the space 60.

Accordingly, according to the above-described embodiment, the turbo compressor 4 which has the first impeller 21*a* and the second impeller 22*a*, which are spaced apart at a predetermined distance from each other in a direction of an axis and are fixed such that their backs face each other, in the rotation shaft 23 which is rotatably supported around the axis, has the angular contact ball bearings 100A and 100B which are provided between the first impeller 21*a* and the second impeller 22*a* and which rotatably support the rotation shaft 23 around the axis. The angular contact ball bearings 100A and 100B are combined such that their fronts face each other. As the angular contact ball bearings 100A and 100B support the rotation shaft 23 between the first impeller 21*a* and the second impeller 22*a*, an overhang load can be reduced, and any load in the thrust direction as well as the radial direction can also be received by the angular contact ball bearings 100A and 100B. Additionally, an allowance for the inclination of the rotation shaft can be increased by providing the angular contact ball bearings which are combined such that their fronts face each other.

Accordingly, in the invention, the turbo compressor 4 capable of improving robustness against the inclination of the rotation shaft 23, preventing any damage of the third bearing 24 and extending the lifespan thereof can be provided.

Additionally, in this embodiment, one end of the rotation shaft 23 is supported by a casing which constitutes the second housing 22*e* via the angular contact ball bearings 100A and 100B which are combined such that their fronts face each other, and the other end of the rotation shaft is supported by a casing which constitutes the second housing 22*e* different from the above casing via the fourth bearing 25. Hence, when the rotation shaft 23 is supported by a plurality of casings by a combination of a number of casings, it is possible to cope with any inclination by the eccentricity which is apt to occur in the rotation shaft 23.

Additionally, in this embodiment, the lubricant-supplying device 70 which supplies lubricant to the angular contact ball bearings 100A and 100B which are combined such that their fronts face each other from above through the gap between both the bearings 100A and 100B is provided. In a case where the bearings 100A and 100B are combined such that their fronts face each other, when lubricant is supplied from above through the gap between both the bearings 100A and 100B, the flow path R for the lubricant is formed so as to incline downward toward the outside from the inside in the direction of the axis by a combination structure of counter-bored outer and inner rings of the angular contact ball bearings 100A and 100B. Hence, supply of lubricant to the angular contact ball bearings 100A and 100B can be smoothly performed from one spot.

Additionally, the turbo refrigerator S1 of the invention includes a condenser 1 which cools and liquefies a compressed refrigerant gas X4, an evaporator 3 which evaporates the liquefied refrigerant gas X4 and deprives vaporization heat from an object to be cooled, thereby cooling the object to be cooled, and a turbo compressor 4 which compresses the refrigerant gas X4 evaporated in the evaporator 3 and supplies the refrigerant gas to the condenser 1. Hence, the turbo refrigerator S1 capable of preventing any damage of the bearings and extending the lifespan thereof can be obtained.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A turbo compressor comprising:

a rotation shaft which is rotatably supported around an axis; and a first impeller and a second impeller which are spaced apart at a predetermined distance from each other in a direction of the axis, and which are fixed to the rotation shaft such that their backs face each other; wherein two angular contact ball bearings are provided between the first impeller and the second impeller to rotatably support the rotation shaft around the axis, and the two angular contact ball bearings are combined such that their fronts face each other.;

one end of the rotation shaft is supported by a first structure via the two angular contact ball bearings, and the other end of the rotation shaft is supported by a second structure different from the first structure.

2. The turbo compressor of claim 1, further comprising a lubricant-supplying device which supplies lubricant to both the two angular bearings through a gap between the bearings from above.

3. A refrigerator comprising:

a condenser which cools and liquefies a compressed refrigerant;

an evaporator which evaporates the liquefied refrigerant and deprives vaporization heat from an object to be cooled, thereby cooling the object to be cooled; and turbo compressor of claim 1, wherein the turbo compressor compresses the refrigerant evaporated in the evaporator and supplies the refrigerant to the condenser.

4. A refrigerator comprising:

a condenser which cools and liquefies a compressed refrigerant;

an evaporator which evaporates the liquefied refrigerant and deprives vaporization heat from an object to be cooled, thereby cooling the object to be cooled; and turbo compressor of claim 2, wherein the turbo compressor compresses the refrigerant evaporated in the evaporator and supplies the refrigerant to the condenser.

* * * * *